US012222113B2

(12) United States Patent
He

(10) Patent No.: US 12,222,113 B2
(45) Date of Patent: Feb. 11, 2025

(54) MOBILE AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Bowen He, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 183 days.

(21) Appl. No.: 17/802,277

(22) PCT Filed: Jul. 24, 2020

(86) PCT No.: PCT/CN2020/103979
§ 371 (c)(1),
(2) Date: Aug. 25, 2022

(87) PCT Pub. No.: WO2021/217917
PCT Pub. Date: Nov. 4, 2021

(65) Prior Publication Data

US 2023/0142583 A1 May 11, 2023

(30) Foreign Application Priority Data

Apr. 30, 2020 (CN) ..... 202010370229.X

(51) Int. Cl.
*F24F 1/03* (2019.01)
*F24F 1/029* (2019.01)
(Continued)

(52) U.S. Cl.
CPC ..... *F24F 1/03* (2019.02); *F24F 1/029* (2019.02); *F24F 13/20* (2013.01); *F24F 13/32* (2013.01); *F24F 2221/12* (2013.01)

(58) Field of Classification Search
CPC ..... F24F 1/03; F24F 1/029; F24F 1/22; F24F 1/04; F24F 13/20; F24F 13/32;
(Continued)

(56) References Cited

U.S. PATENT DOCUMENTS

2018/0100664 A1 4/2018 Keogh

FOREIGN PATENT DOCUMENTS

CA 3031267 A1 4/2019
CN 202792278 U 3/2013
(Continued)

OTHER PUBLICATIONS

The European Patent Office (EPO) Extended Search Report for EP Application No. 20933496.0 Jul. 18, 2023 11 Pages.
(Continued)

*Primary Examiner* — Emmanuel E Duke
(74) *Attorney, Agent, or Firm* — Anova Law Group, PLLC

(57) ABSTRACT

A mobile air conditioner includes a housing, an electric control box mounted at the housing, and a wire control assembly mounted at the housing. The wire control assembly includes an adapter mounted at the housing and connected to the electric control box, and a wire controller connected to the adapter.

19 Claims, 11 Drawing Sheets

(51) Int. Cl.
*F24F 13/20* (2006.01)
*F24F 13/32* (2006.01)

(58) Field of Classification Search
CPC ..... F24F 2221/12; F24F 11/38; F24F 11/58; F24F 11/89; G08C 17/02
See application file for complete search history.

(56) References Cited

FOREIGN PATENT DOCUMENTS

| | | | | |
|---|---|---|---|---|
| CN | 203708705 | U | * | 7/2014 |
| CN | 205606843 | U | | 9/2016 |
| CN | 108028674 | A | | 5/2018 |
| CN | 108344064 | A | | 7/2018 |
| CN | 208186824 | U | | 12/2018 |
| CN | 208398332 | U | | 1/2019 |
| CN | 208850083 | U | | 5/2019 |
| CN | 209978320 | U | | 1/2020 |
| CN | 210118889 | U | * | 2/2020 |
| CN | 111396996 | A | | 7/2020 |
| CN | 212319922 | U | | 1/2021 |
| EP | 3358750 | A1 | | 8/2018 |
| IN | 107289535 | A | | 10/2017 |
| JP | 2015081723 | A | | 4/2015 |
| JP | 2016121833 | A | | 7/2016 |
| JP | 2020026893 | A | | 2/2020 |
| WO | 2017082833 | A1 | | 5/2017 |

OTHER PUBLICATIONS

World Intellectual Property Organization (WIPO) International Search Report and Written Opinion for PCT/CN2020/103979 Jan. 29, 2021 16 Pages (with translation).

China National Intellectual Property Administration (CNIPA) Office Action 1 for Application No. 202010370229.X Sep. 24, 2024 20 Pages (including translation).

* cited by examiner

MOBILE AIR CONDITIONER

CROSS-REFERENCE TO RELATED APPLICATIONS

This application is a National Stage Entry under 35 U.S.C. § 371 of International Application No. PCT/CN2020/103979, filed on Nov. 5, 2020, which claims priority to Chinese Patent Application No. 202010370229.X, filed on Apr. 30, 2020, and entitled "MOBILE AIR CONDITIONER," the entire contents of both of which are incorporated herein by reference.

TECHNICAL FIELD

The present disclosure relates to the technical field of mobile air conditioners, and in particular, to a mobile air conditioner.

BACKGROUND

In the related art, conventional mobile air conditioners are usually additionally equipped with a remote control, and the operation of the mobile air conditioner is remotely controlled through the remote control. However, once the remote control fails or is lost, the user needs to reconfigure a new remote control to continue to control the operation of the mobile air conditioner, which leads to poor applicability of the mobile air conditioner and greatly reduces the experience of using the mobile air conditioner.

The foregoing description is to provide general background information and does not constitute prior art.

SUMMARY

The present disclosure provides a mobile air conditioner, including a housing, an electric control box mounted at the housing, and a wire control assembly mounted at the housing. The wire control assembly includes a wire controller and an adapter for adapting the wire controller. The adapter is mounted at the housing, the adapter is connected to the electric control box, and the wire controller is connected to the adapter.

In an embodiment, the housing includes a chassis, the chassis includes a bottom plate, a lower surface of the bottom plate is provided with a mounting plate, the adapter is mounted at the mounting plate, and a connection end of the adapter extends toward a side of the chassis for connecting the wire controller.

In an embodiment, an upper surface of the bottom plate is provided with a wiring channel for a wire of the adapter to pass through, an opening is formed at a lower end of the wiring channel, and the opening is located at a side of the mounting plate away from the wire controller.

In an embodiment, a channel enclosure plate protrudes from the upper surface of the bottom plate, the channel enclosure plate encloses to form the wiring channel, and a wire outlet hole is provided at a side wall of the channel enclosure plate, for leading the wire of the adapter out of the wiring channel.

In an embodiment, the mounting plate is provided with an extension port for the adapter to pass through, a first positioning block extends from a top surface of the adapter at a position away from the connection end of the adapter, and the first positioning block is configured to abut against a periphery, that faces the opening, of the extension port after the adapter protrudes from the extension port.

In an embodiment, each of two opposite sides of the adapter is provided with a second positioning block, the second positioning block extends from the extension port along with the connection end of the adapter, and is configured to abut against a periphery, that faces away from the opening, of the extension port.

In an embodiment, the second positioning block is provided with a front guide surface in a slope shape, the front guide surface extends from a top of the second positioning block toward the connection end of the adapter; and/or the second positioning block is provided with a rear guide surface in a slope shape, the rear guide surface extends from a top of the second positioning block to be away from the connection end of the adapter.

In an embodiment, a third positioning block protrudes from the top surface of the adapter at a position close to the connection end of the adapter, an elastic buckle is provided at the wire controller, and the elastic buckle is configured to buckle and fix with the third positioning block after the wire controller is inserted in and connected to the connection end.

In an embodiment, the chassis is provided with a water receiving groove and an installation position for installing a compressor, the chassis is configured to form an electrical appliance accommodation area between the water receiving groove and the installation position, and the electrical appliance accommodation area is configured for accommodating and installing an electrical component.

In an embodiment, the mobile air conditioner further includes an electrical appliance protective cover. The electrical appliance protective cover is provided in the electrical appliance accommodation area and is configured to cover the electrical component and/or the wiring channel in the electrical appliance accommodation area.

In an embodiment, the electrical component includes a first water level detector installed in the electrical appliance accommodation area to detect a first water level in the electrical appliance accommodation area, a side wall of the electrical appliance protective cover is provided with a first notch, and the first notch is configured for checking the first water level detector.

In an embodiment, the electrical component further includes a second water level detector installed in the electrical appliance accommodation area to detect a second water level in the electrical appliance accommodation area, the second water level is higher than the first water level, the side wall of the electrical appliance protective cover is provided with a second notch, and the second notch is configured for checking the second water level detector.

In an embodiment, the electrical component further includes a water pumping motor, the water pumping motor is installed in the electrical appliance accommodation area and connected to a water pumping wheel provided in the water receiving groove, a third notch is provided at a side wall, that faces the water pumping wheel, of the electrical appliance protective cover, and the third notch corresponds to the water pumping motor, for checking the water pumping motor.

In an embodiment, the electrical component further includes a drain valve, the drain valve is installed in the electrical appliance accommodation area to open or close a water outlet of the water receiving groove, a fourth notch is opened on a side, away from the water receiving groove, of the electrical appliance protective cover, and the fourth notch corresponds to the drain valve, for checking the drain valve.

In an embodiment, a top surface of the electrical appliance protective cover corresponding to the drain valve is provided with a wire passage hole, the wire passage hole is configured for a wire of the drain valve to pass through, and the fourth notch extends from a lower edge of the side wall of the electrical appliance protective cover to the wire passage hole.

In an embodiment, a winding post protrudes from the top surface of the electrical appliance protective cover, and the winding post is located at a side of the wire passage hole for winding the wire drawn from the wire passage hole.

In an embodiment, one end of the electrical appliance protective cover is configured with a fixation member, another end of the electrical appliance protective cover is further configured with an insertion member, the chassis is configured with an insertion part and a fixation part, the insertion part is inserted in and connected to the insertion member, and the fixation part is fixedly connected to the fixation member.

In an embodiment, a support plate is configured to protrude laterally from one end of the electrical appliance protective cover, the support plate is adjacent to the fixation member, the support plate is supported on an upper end of the channel enclosure plate of the bottom plate, and is configured to cover the opening of the channel enclosure plate.

In technical solutions of the present disclosure, the wire control assembly is provided at the mobile air conditioner. The wire control assembly includes the wire controller and the adapter for adapting the wire controller. The wire controller is connected to the electric control box through the adapter. The mobile air conditioner can receive the remote control signal from the remote control or other control terminal through WiFi, and there is no need to be equipped with the remote control, or when the remote control fails or is lost, the control terminal can send the remote control signal through WiFi to control the operation of the mobile air conditioner. The resulting array substrate may be partially short-circuited, which affects the display performance, thereby improving the stability of the array substrate.

BRIEF DESCRIPTION OF THE DRAWINGS

In order to more clearly illustrate the technical solutions in the embodiments of the present disclosure or in the prior art, the following briefly introduces the accompanying drawings that need to be used in the description of the embodiments or the existing technologies. Obviously, the drawings in the following description are only some embodiments of the present disclosure. For those of ordinary skill in the art, other drawings can also be obtained based on the structures shown in these drawings without any creative effort.

DESCRIPTION OF REFERENCE CHARACTERS

Figure 1:
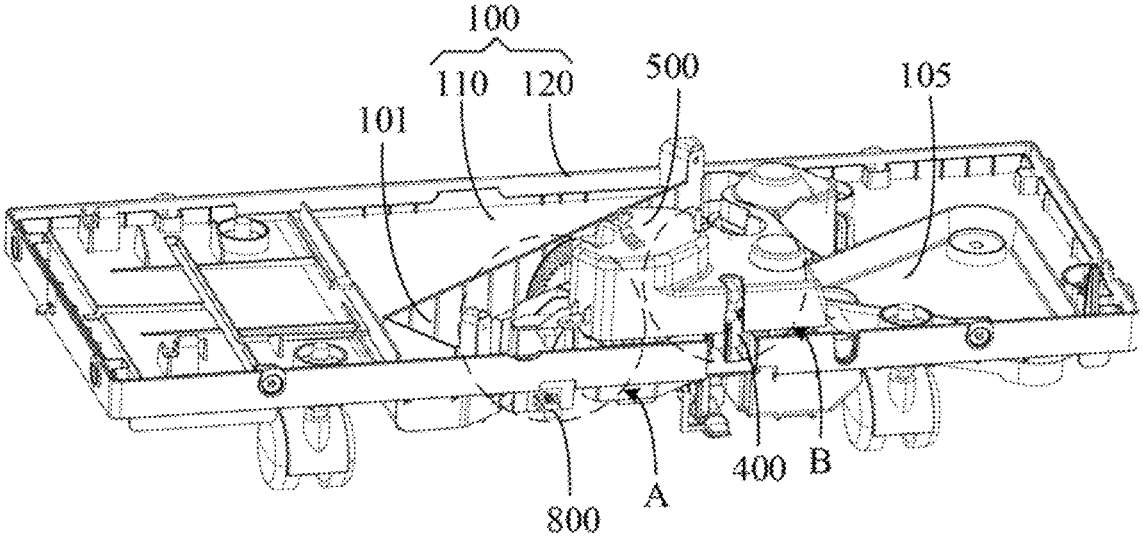
FIG. 1 is a partial schematic structural view of a mobile air conditioner according to an embodiment of the present disclosure.

| Reference character | Name | Reference character | Name |
|---|---|---|---|
| 100 | chassis | 502 | second notch |
| 110 | bottom plate | 503 | third notch |
| 118 | insertion part | 504 | fourth notch |
| 119 | fixation part | 505 | wire passage hole |
| 101 | water receiving groove | 600 | water pumping assembly |
| 102 | water outlet | 610 | water pumping wheel |
| 105 | installation position | 620 | water pumping motor |
| 106 | electrical appliance accommodation area | 710 | first water level detector |
| 120 | side plate | 720 | second water level detector |
| 126 | overflow port | 800 | wire control assembly |
| 130 | drainpipe | 810 | wire controller |
| 190 | mounting plate | 811 | positioning groove |
| 191 | extension port | 812 | elastic buckle |
| 400 | drain valve | 820 | adapter |
| 412 | wiring terminal | 823 | first positioning block |
| 500 | electrical appliance protective cover | 824 | second positioning block |
| 510 | insertion member | 825 | third positioning block |
| 540 | support leg | 900 | wiring channel |
| 550 | winding post | 910 | channel enclosure plate |
| 501 | first notch | 911 | wire outlet hole |

The realization of the objective, functional characteristics, and advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

Besides, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

FIG. 1 to FIG. 17 are the drawings of the description of the mobile air conditioner of the present disclosure. The present disclosure provides a mobile air conditioner capable of cooling or heating an indoor environment to adjust the temperature of the indoor environment. The mobile air conditioner adopts a new method for installing the drain valve, which can reduce the corrosion caused by the use of screws and improve the stability for installing the drain valve.

In an embodiment, the mobile air conditioner includes a housing, and an indoor heat exchanger and an outdoor heat exchanger installed in the housing. An outdoor heat exchange chamber and an indoor heat exchange chamber located above the outdoor heat exchange chamber are provided inside the housing. The outdoor heat exchanger is installed in the outdoor heat exchange chamber. The indoor heat exchanger is installed in the indoor heat exchange chamber.

When the mobile air conditioner is cooling the indoor environment, the air in the indoor environment enters the indoor heat exchange chamber, and after heat exchange by the indoor heat exchanger, cold air is generated and blown out to the indoor environment to cool the indoor environment. At the same time, the air in the indoor environment or the outdoor environment enters the outdoor heat exchange chamber, and after heat exchange by the outdoor heat exchanger, hot air is generated and finally discharged to the outdoors through the exhaust pipe.

Figure 2:
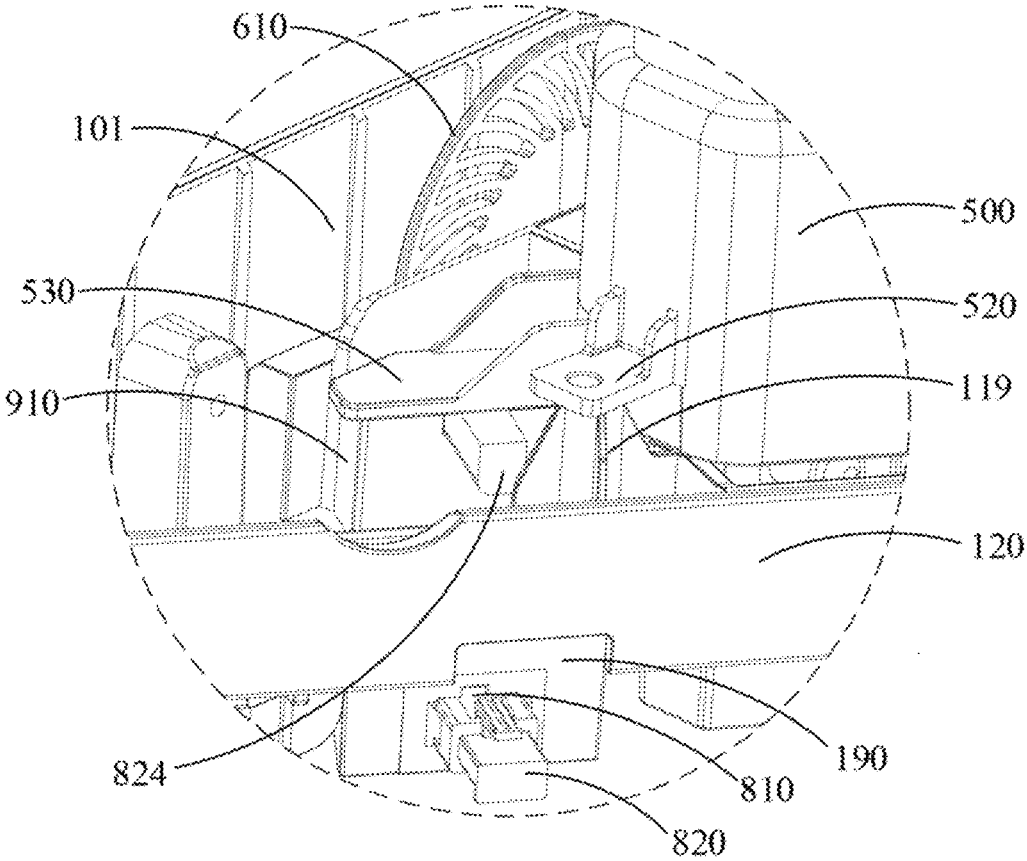
FIG. 2 is an enlarged view of portion A in FIG. 1.
Figure 11:
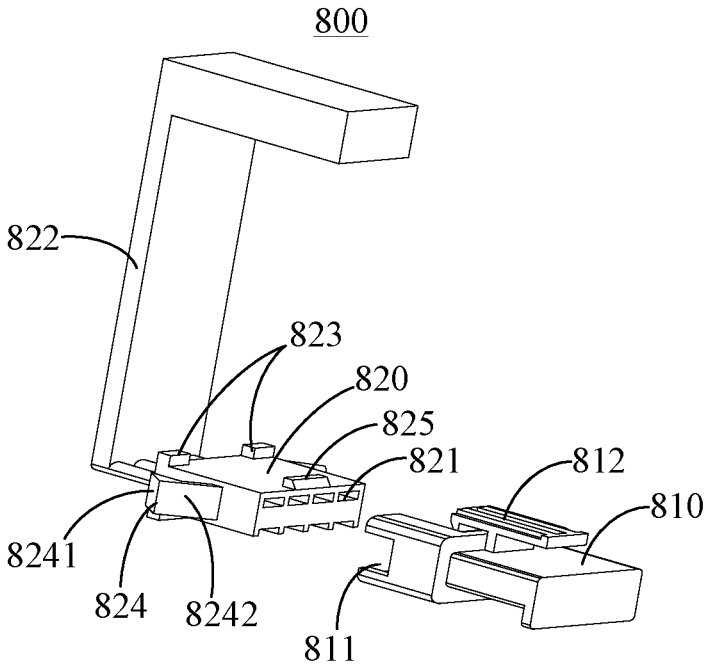
FIG. 11 is a schematic structural view of a wire control assembly in FIG. 7.

As shown in FIG. 1 and FIG. 2, in an embodiment, the mobile air conditioner includes a housing and a wire control assembly 800. An electric control box is provided in the housing, and the wire control assembly 800 is installed on the housing. The wire control assembly 800 includes a wire controller 810 and an adapter 820 for adapting the wire controller 810 (as shown in FIG. 11). The adapter 820 is installed on the housing, and the adapter 820 is connected to the electric control box through the wire 822. The wire controller 810 is located outside the housing, and the wire controller 810 is connected to the connection end 821.

The housing includes a chassis 100 and a cover mounted at the chassis 100. The adapter 820 of the wire control assembly 800 may be installed on the cover or the chassis 100, as long as the connection end of the adapter 820 is exposed outside the housing. That is, the remote control 810 is also located outside the housing. Therefore, the operator can connect the wire controller 810 to the adapter 820 on the outside of the housing, without disassembling the housing, and without being blocked by other components, which greatly reduces the difficulty of disassembling and assembling the wire controller 810, and is convenient for the user to check the wire controller 810. By checking the wire controller 810, the user can determine whether the wire controller 810 is faulty or the electric control box is faulty, and then determine whether to disassemble the housing.

The wire controller 810 and the adapter 820 of the wire control assembly 800 are common in the current market. When the wire control assembly 800 is working, the wire controller 810 can receive the command signal sent by the remote controller or other control terminal through WiFi, and the command signal is transmitted to the electric control box connected to the wire controller 810 through the adapter 820. After receiving the command signal, the electric control box may control the corresponding electrical components to perform operations corresponding to the signal. The control terminal that sends out the remote control signal through WiFi may be a mobile phone, a computer, or the like. Therefore, the mobile air conditioner does not need to be equipped with a remote control, or when the remote control fails or is lost, the control terminal can send the remote control signal through WiFi to control the operation of the mobile air conditioner.

In technical solutions of the present disclosure, the wire control assembly 800 is provided at the mobile air conditioner. The wire control assembly 800 includes the wire controller 810 and the adapter 820 for adapting the wire controller 810. The wire controller 810 is connected to the electric control box through the adapter 820. The mobile air conditioner can receive the remote control signal from the remote control or other control terminal through WiFi, and there is no need to be equipped with the remote control, or when the remote control fails or is lost, the control terminal can send the remote control signal through WiFi to control the operation of the mobile air conditioner.

Figure 4:
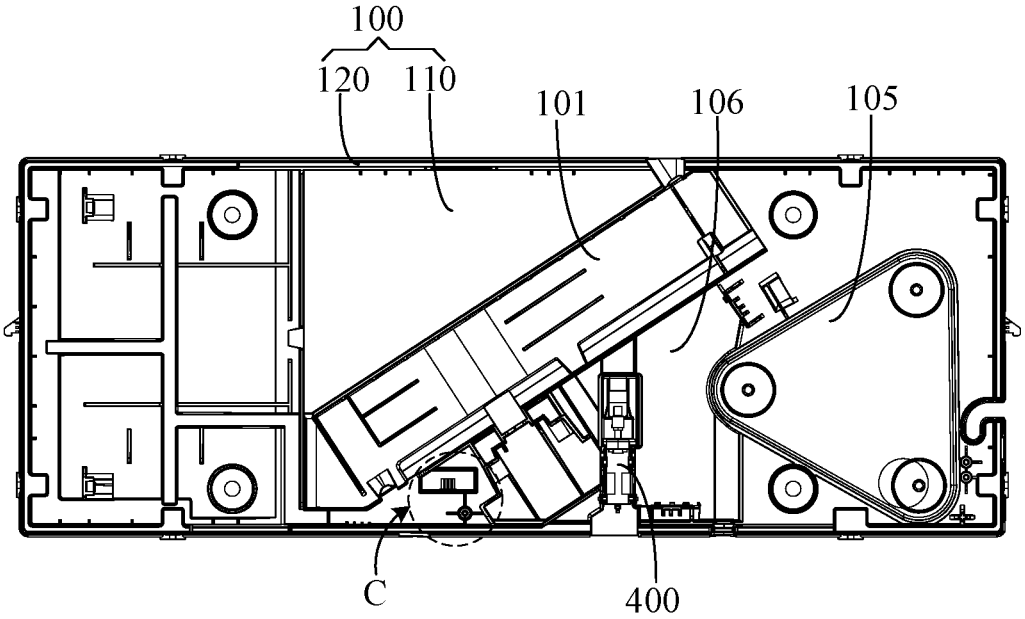
FIG. 4 is a top view of a chassis in FIG. 1.
Figure 5:
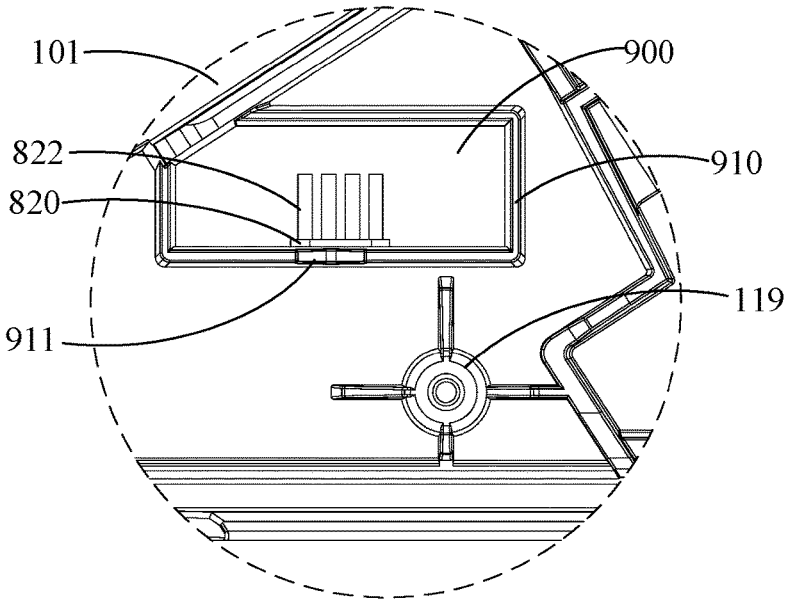
FIG. 5 is an enlarged view of portion C in FIG. 4.
Figure 6:
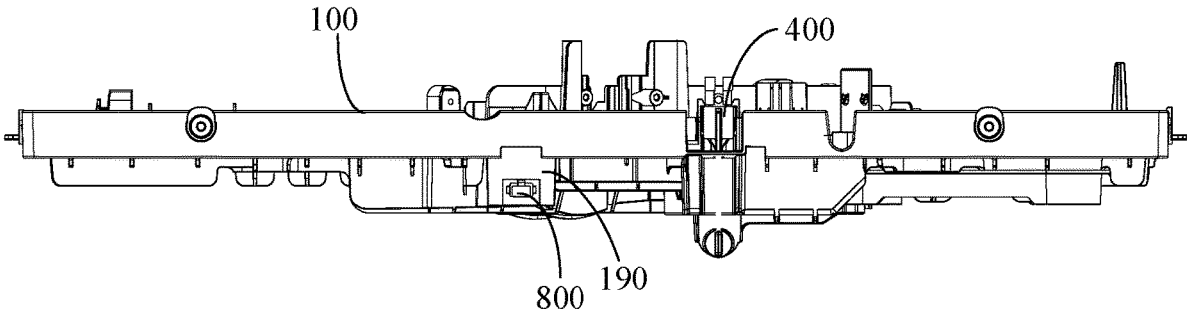
FIG. 6 is a side view of the chassis in FIG. 1.

As shown in FIG. 4 to FIG. 6, in an embodiment, in order to maintain and repair the wire controller 810, the wire controller 810 may be provided outside the housing, which not only facilitates the user to disassemble and assemble the wire controller 810 on the outside, so as to repair or replace the wire controller 810. Besides, since the wire controller 810 is not easily blocked by the housing of the mobile air conditioner or its internal components, the wire controller 810 is easier to receive the remote control command signal, which improves the signal receiving efficiency of the wire controller 810. The housing includes a chassis 100 and a cover (not shown) mounted at the chassis 100, and the wire controller 810 may be disposed outside the chassis 100 or outside the housing.

Figure 7:
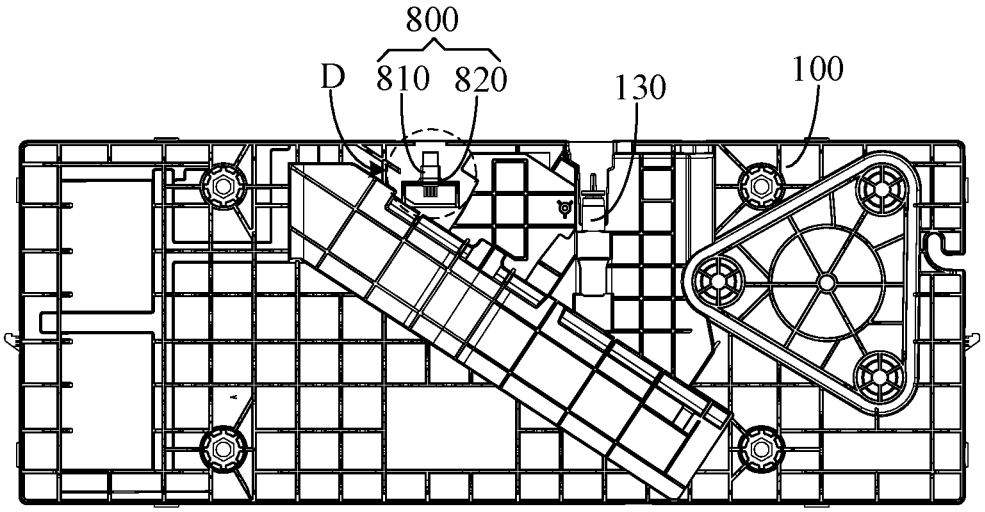
FIG. 7 is a bottom view of the chassis in FIG. 1.
Figure 8:
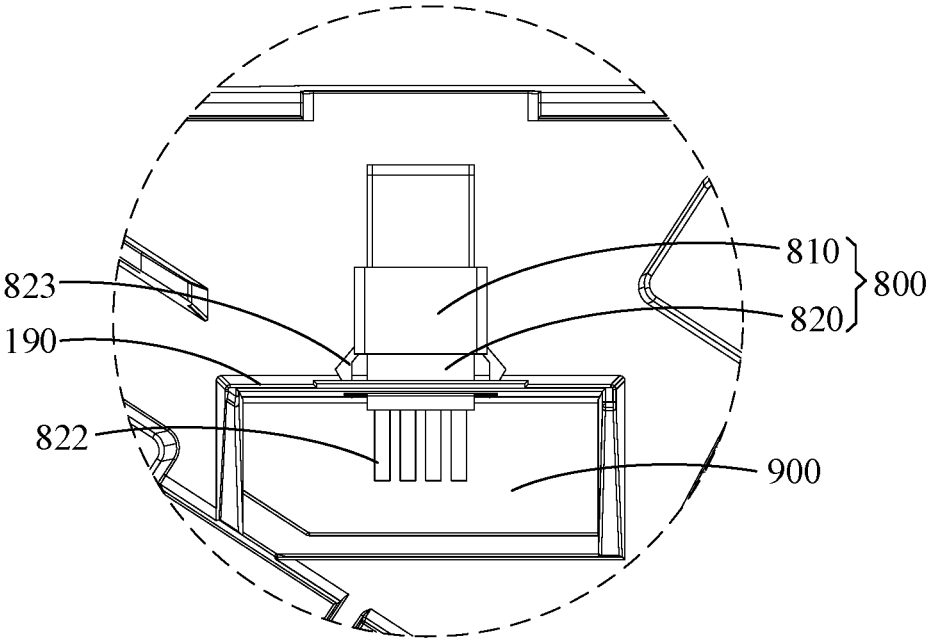
FIG. 8 is an enlarged view of portion D in FIG. 7.

As shown in FIG. 6 to FIG. 8, the wire controller 810 may be provided at the chassis 100. The chassis 100 includes a bottom plate 110 and a side plate 120 provided along the periphery of the bottom plate 110. A lower surface of the bottom plate 110 is provided with a mounting plate 190. The adapter 820 is mounted at the mounting plate 190, and a connection end 821 of the adapter 820 extends toward a side of the chassis for connecting the wire controller 810. The mounting plate 190 is provided at the lower surface of the bottom plate 110. Therefore, when installing the remote control 810, the operator can extend the remote control 810 to the mounting plate 190 under the chassis 100 from one side of the chassis 100 (such as the front side, the rear side, the left side, the right side), and the wire controller 810 can be inserted into the connection end 821 of the adapter 820.

Figure 9:
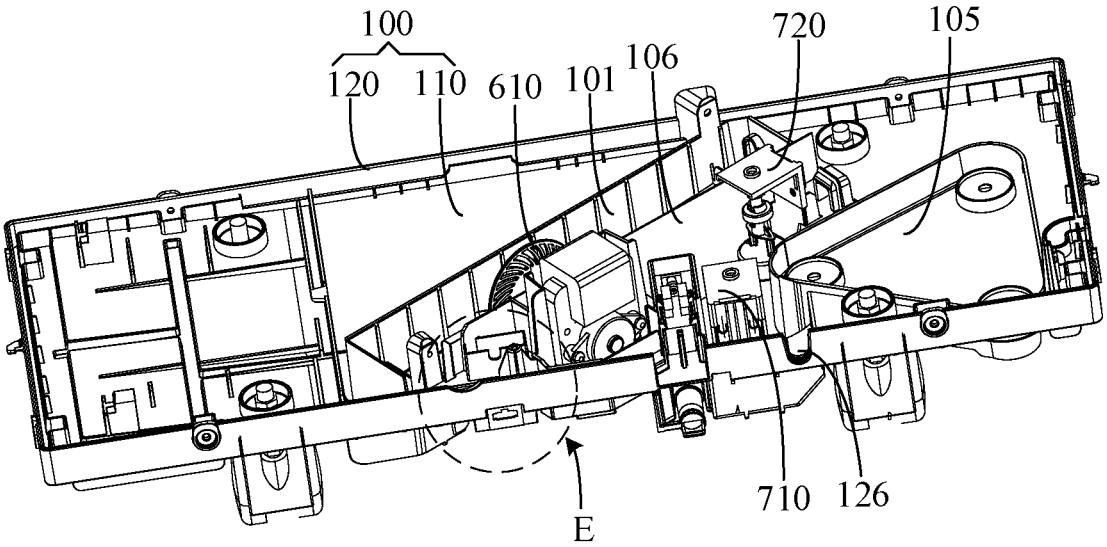
FIG. 9 is a schematic view showing the chassis engaging with an electrical appliance protective cover in FIG. 7.
Figure 10:
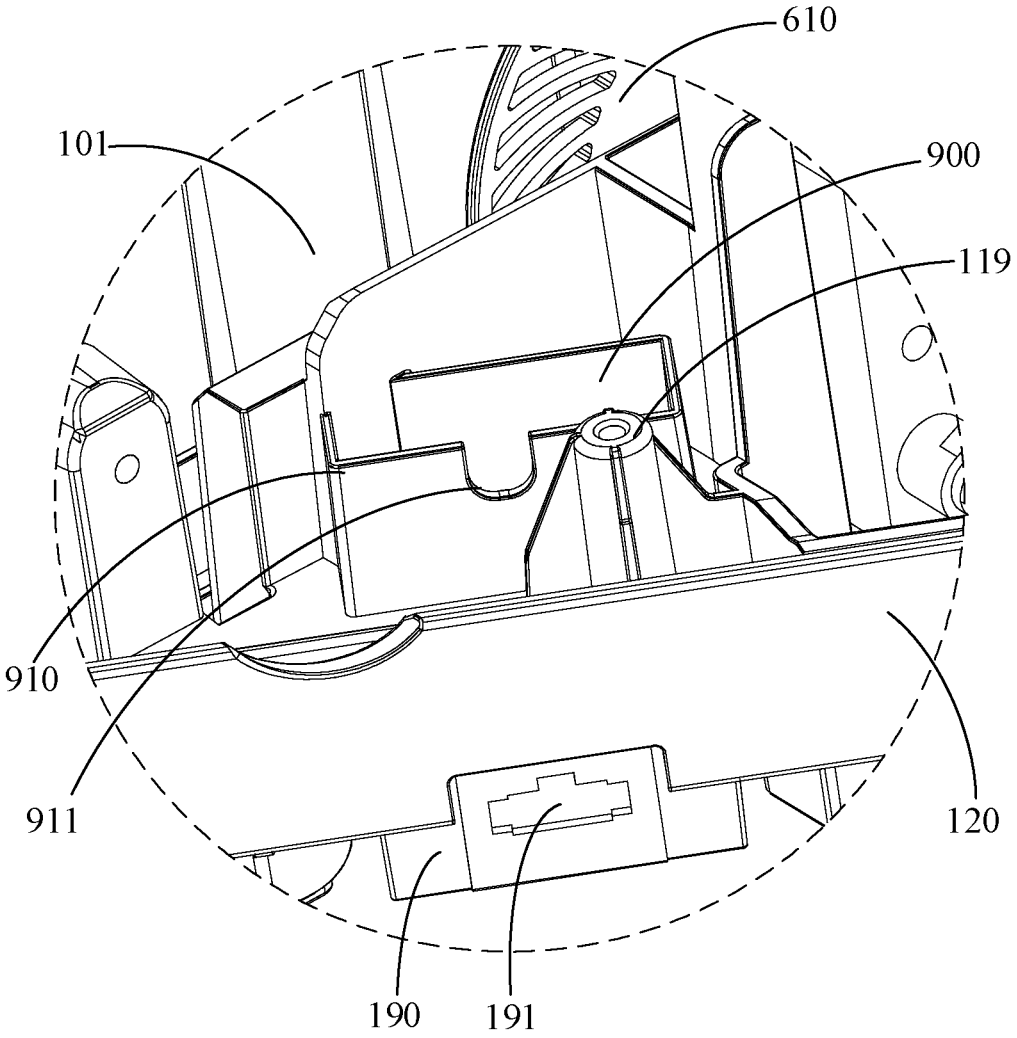
FIG. 10 is an enlarged view of portion E in FIG. 9.

As shown in FIG. 8 to FIG. 10, the bottom plate 110 is provided with a wiring channel 900 for a wire of the adapter 820 to pass through, an opening is formed at a lower end of the wiring channel 900, and the opening is located at a side of the mounting plate 190 away from the wire controller 810. That is, for the same side plate 120 of the chassis 100, the mounting plate 190 is closer to the side plate 120 than the wiring channel 900, which is convenient for the operator to connect the wire controller 810 with the adapter 820 nearby.

Since the position where the wire controller 810 and the adapter 820 are connected is located at the open side of the mounting plate 190 away from the wiring channel 900, even if the condensed water of the water receiving groove 101 or the outdoor heat exchanger or its surrounding components falls into the wiring channel 900, the condensed water will be blocked by the mounting plate 190, and will not fall to the position where the wire controller 810 and the adapter 820 are connected. That is, the mounting plate 190 can be used as a water blocking plate for the wire controller 810, to effectively waterproof the wire controller 810.

When installing the wire control assembly 800, the adapter 820 of the wire control assembly 800 may extend from the side of the mounting plate 190 corresponding to the opening to the side away from the opening (and vice versa), and the adapter 820 is fixedly connected to the mounting plate 190. The connection end 821 of the adapter 820 is located at the side, that faces away from the opening, of the mounting plate 190. A wire 822 may extend from the end of the adapter 820 away from the connection end 821. The wire 822 may extend upwards into the wiring channel 900 from the opening at the lower end of the wiring channel 900, and then pass through the upper end of the wiring channel 900 and is connected to the electric control box. The wire controller 810 is connected to the connection end 821 of the adapter 820 on the side of the mounting plate 190 facing away from the opening at the lower end of the wiring channel 900.

As shown in FIG. 8 to FIG. 10, the upper surface of the bottom plate 110 may produce condensed water. To avoid the condensed water dripping from the wiring channel 900 to the floor of the room, in an embodiment, a channel enclosure plate 910 protrudes from the upper surface of the bottom plate 110, the channel enclosure plate 910 encloses to form the wiring channel 900, and a wire outlet hole 911 is provided at a side wall of the channel enclosure plate 910, for the wire 822 of the adapter 820 to pass through the wiring channel 900. The wire 822 is passed out and then connected to the electric control box.

The channel enclosure plate 910 is close to the water receiving groove of the chassis, and the channel enclosure plate 910 is provided with the wire outlet hole 911 on the side wall away from the water receiving groove 101. The opening at the upper end of the channel enclosure plate 910 can be provided with a cover plate or covered by the electrical appliance protective cover 500. When there is water on the upper surface of the bottom plate 110, the water will be blocked by the channel enclosure plate 910, and will be difficult to flow into the wiring channel 900, thereby avoiding a water leakage accident and causing trouble to users.

As shown in FIG. 8, FIG. 10 and FIG. 11, in an embodiment, in order to facilitate passing the adapter 820 out of the mounting plate 190, the mounting plate 190 is provided with an extension port 191 for the adapter 820 to pass through. The adapter 820 may be fixed with the extension port 191 by interference fit, or a positioning structure can be provided between the adapter 820 and the extension port 191 to fix the adapter 820 in the extension port 191. In an embodiment, a first positioning block 823 protrudes from a top surface of the adapter 820 at a position away from the connection end of the adapter 820, and the first positioning block 823 is configured to abut against a periphery, that faces the opening, of the extension port 191 after the connection end 821 of the adapter 820 protrudes from the extension port 191. The first positioning block 823 protrudes from the side surface of the adapter 820.

When installing the adapter 820, the connection end 821 of the adapter 820 extends from the inner side (i.e., the side of the extension port 191 corresponding to the opening) of the extension port 191 to the outer side (i.e., the side of the extension port 191 facing away from the opening) of the extension port 191 until after the connection end 821 completely protrudes from the outer side of the extension port 191, the first positioning block 823 on the adapter 820 abuts against the inner periphery of the extension port 191, so that the adapter 820 cannot continue to pass through the extension port 191. Since the center of gravity of the adapter 820 tends to fall on the outer side of the mounting plate 190, the connection end 821 of the adapter 820 has a downward slope. The connection end of the adapter 820 has a tendency to incline upward, but is resisted by the first positioning block 823 and the inner periphery of the extension port 191, so that the adapter 820 is not easy to fall out from the extension port 191.

Further, in order to improve the stability of installing the adapter 820, in an embodiment, each side of the adapter 820 is provided with a second positioning block 824, the second positioning block 824 extends from the extension port 191 along with the connection end 821 of the adapter 820, and is configured to abut against the periphery of the extension port 191 away from the opening. The second positioning block 824 protrudes from the side surface of the adapter 820.

After the adapter 820 is installed at the extension port 191, the first positioning block 823 may abut against the inner periphery of the extension port 191, and the second positioning block 824 may abut against the outer periphery of the extension port 191, thereby limiting the movement of the adapter 820 along the inward and outward direction of the extension port 191. Under the action of no strong external force, the adapter 820 is not easy to fall out from the extension port 191. When the adapter 820 needs to be disassembled, a strong force is applied to the adapter 820 to overcome the resistance of the first positioning block 823 or the second positioning block 824, and the adapter 820 can be removed.

In an embodiment, the second positioning block 824 is provided with a front guide surface 8241 extending in a slope shape from a top of the second positioning block 824 toward the connection end 821 of the adapter 820. During the process of passing the adapter 820 from the inner side of the extension port 191 to the outer side of the extension port 191, the side edge of the extension port 191 slides along the front guide surface 8241 of the second positioning block 824, to reduce the resistance of the second positioning block 824 to the installation of the adapter 820, and reduce the difficulty of installing the adapter 820 to the extension port 191.

In addition, the second positioning block 824 may also be provided with a rear guide surface 8242 extending in a slope shape from a top of the second positioning block 824 away from the connection end of the adapter 820. During the process of disassembling the adapter 820 from the outer side of the extension port 191 to the inner side of the extension port 191, the side edge of the extension port 191 slides along the rear guide surface 8242 of the second positioning block 824, to reduce the resistance of the second positioning block 824 to the disassembly of the adapter 820, and reduce the difficulty of disassembling the adapter 820.

An angle is formed between the front guide surface 8241 of the second positioning block 824 and the rear guide surface 8242 of the second positioning block 824. A top portion that can abut against the outer periphery of the extension port 191 is formed at the angle position between the front guide surface 8241 and the rear guide surface 8242. The angle between the front guide surface 8241 and the rear guide surface 8242 may be 80° to 120°, such as but not limited to 85°, 90°, 95°, 100°, 105°, 110°, 115°, or the like.

In an embodiment, the wire controller 810 is inserted in and connected to the connection end 821 of the adapter 820. In order to enhance the firmness of the connection between the wire controller 810 and the adapter 820, in an embodiment, two opposite sides of the remote controller 810 are provided with positioning grooves 811 with forward openings, and the positioning grooves 811 are inserted into the second positioning blocks 824. When the wire controller 810 is inserted into the connection end 821 of the adapter 820, the positioning groove 811 on the wire controller 810 is aligned with the second positioning block 824. After the wire controller 810 is inserted into the connection end 821 of the adapter 820, the second positioning block 824 just enters the positioning groove 811, and the two fit together to define the wire controller 810.

Further, a third positioning block 825 protrudes from the top surface of the adapter 820 at a position close to the connection end 821 of the adapter 820, an elastic buckle 812 is provided at the wire controller 810, and the elastic buckle 812 is configured to buckle and fix with the third positioning block 825 after the wire controller 810 is inserted in and connected to the connection end 821. That is, after the insertion of the wire controller 810 and the connection end 821 of the adapter 820 is completed, the elastic buckle 812 of the wire controller 810 is just fastened to the third positioning block 825 of the adapter 820. In this way, the wire controller 810 is further fixedly connected to the adapter 820, which greatly improves the firmness of the installation of the wire controller 810, and the wire controller 810 does not easily fall off.

As shown in FIG. 9, based on any of the above embodiments, the chassis 100 is provided with a water receiving groove 101 and an installation position 105 for a compressor to be installed. The chassis 100 is configured to form an electrical appliance accommodation area 106 between the water receiving groove 101 and the installation position 105, and the electrical appliance accommodation area 106 is configured for accommodating and installing an electrical component.

The water receiving groove 101 on the chassis 100 is located below the outdoor heat exchanger for receiving the condensed water generated by the outdoor heat exchanger. Generally, a large vacant area is formed between the water receiving groove 101 and the installation position 105 for the compressor to be installed, so that the vacant area may form an electrical appliance accommodation area 106, for accommodating and installing the power supply components, making full use of the internal space of the mobile air conditioner and effectively regulating the distribution of the internal components of the mobile air conditioner. The wiring channel 900 is close to or within the electrical appliance accommodation area 106. After the wires of the adapter 820 are extended out of the wiring channel 900, the wires of the adapter 820 and the wires of the electrical components in the electrical appliance accommodation area 106 form a wiring harness and are connected to the electric control box together.

Figure 12:
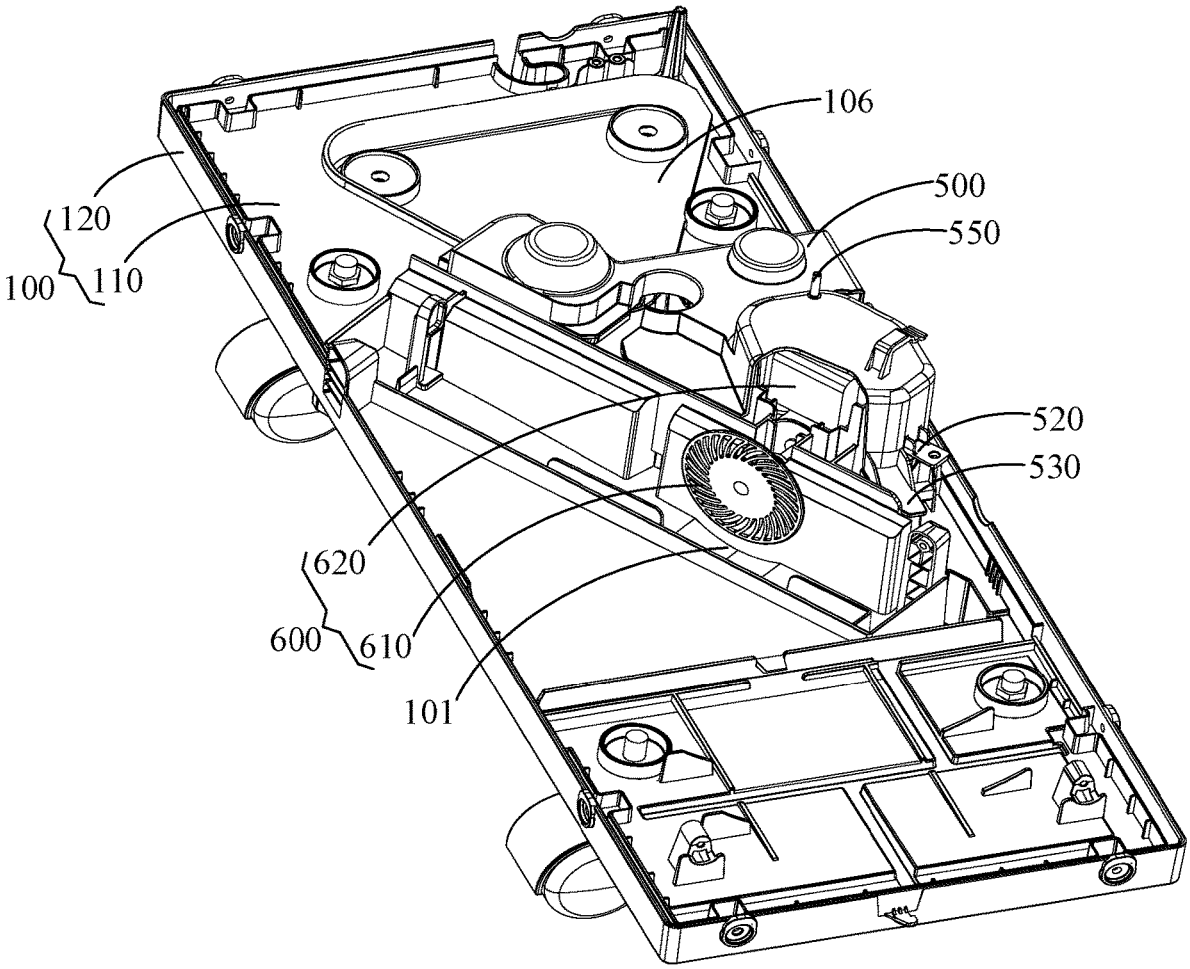
FIG. 12 is a schematic view showing the chassis engaging with the electrical appliance protective cover in FIG. 9, viewed from another perspective.

As shown in FIG. 9 and FIG. 12, in an embodiment, the mobile air conditioner further includes an electrical appliance protective cover 500. The electrical appliance protective cover 500 is provided in the electrical appliance accommodation area 106 and is configured to cover the electrical component and/or the wiring channel in the electrical appliance accommodation area 106.

Figure 15:
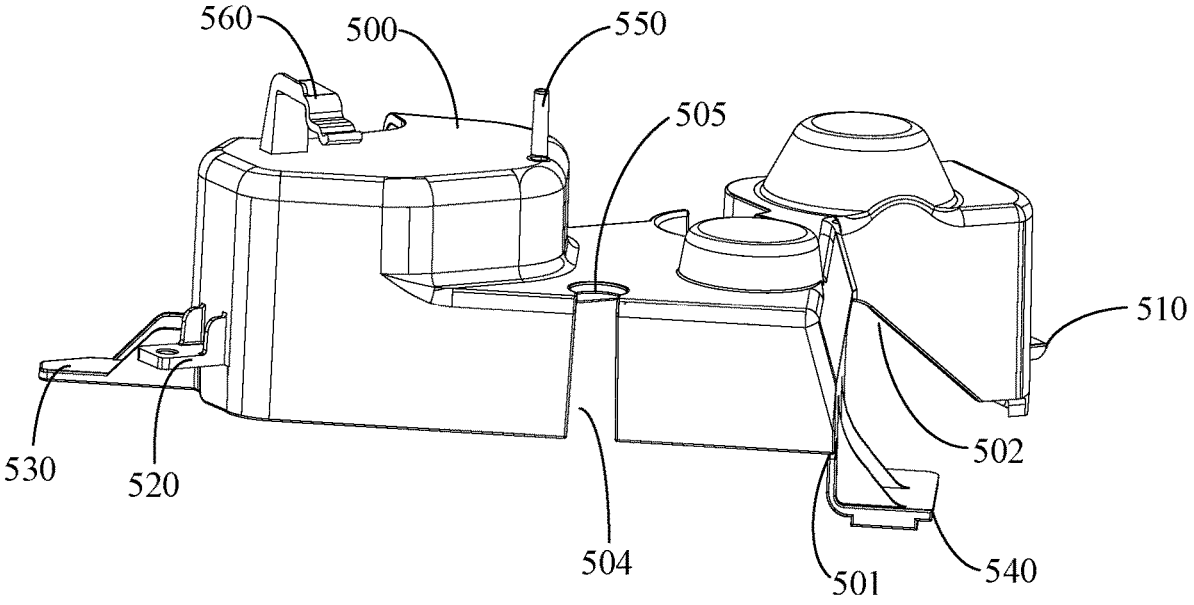
FIG. 15 is a schematic structural view of the electrical appliance protective cover in FIG. 9.
Figure 16:
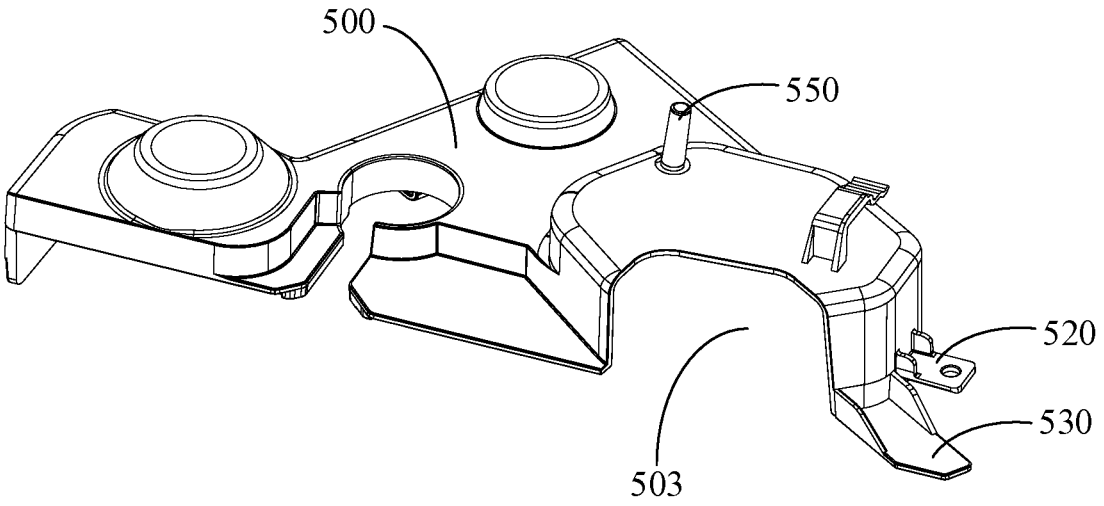
FIG. 16 is a schematic view of the electrical appliance protective cover in FIG. 15, viewed from another perspective.
Figure 17:
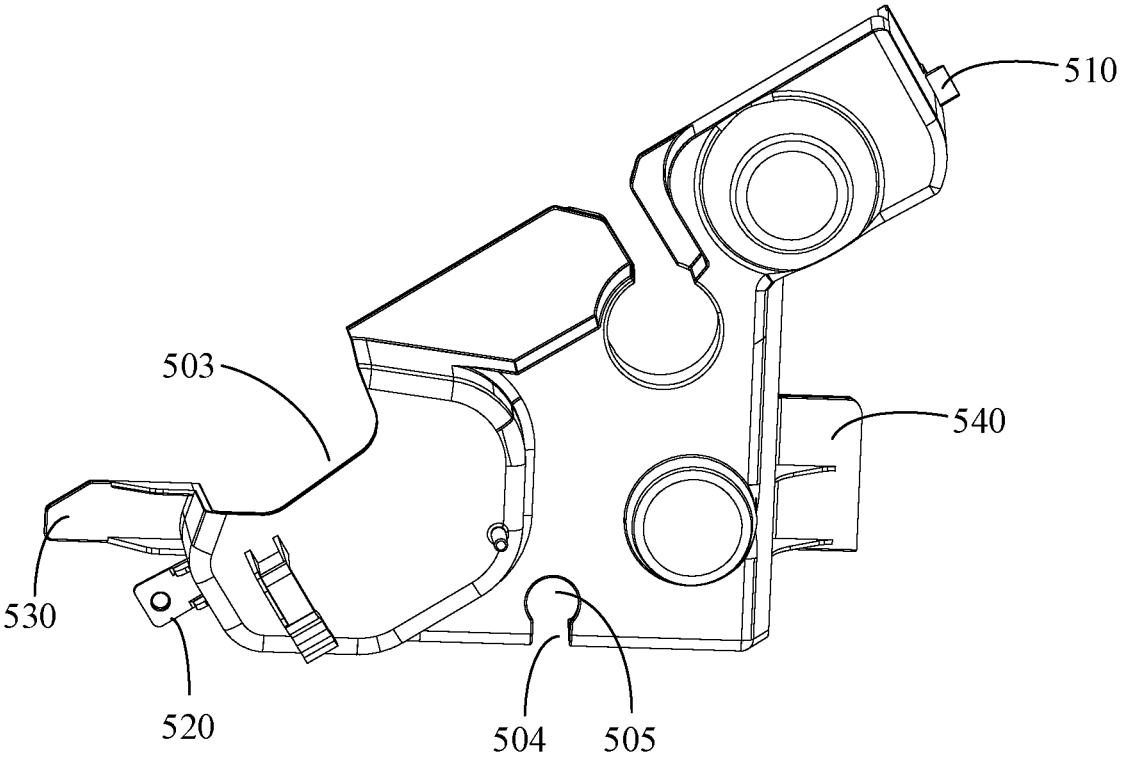
FIG. 17 is a schematic view of the electrical appliance protective cover in FIG. 15, viewed from another perspective.

FIG. 15 to FIG. 17 are schematic structural views of the electrical appliance protective cover 500 from different perspectives. The electrical appliance protective cover 500 can not only prevent the water droplets inside the mobile air conditioner from falling on the electrical components or the wiring channel 900, but also prevent the electrical components or the wires in the wiring channel 900 from being damp and causing leakage or damage. Moreover, surrounding components can also be prevented from colliding or being squeezed against the wiring channel 900 or the electrical components. The electrical components may be any one or more of the first water level detector 710, the second water level detector 720, the water pumping motor 620, and the drain valve 400, which will be described in detail in the following embodiments.

As shown in FIG. 9 and FIG. 12, in an embodiment, the electrical component further includes a first water level detector 710. The first water level detector 710 is installed in the electrical appliance accommodation area 106 to detect a first water level in the electrical appliance accommodation area 106, and feed the first water level signal back to the control device of the mobile air conditioner, and then the control device may receive the first water level signal for alarm or drainage.

Since the electrical appliance protective cover 500 covers the first water level detector 710 in its interior, it is difficult for maintenance personnel to view the first water level detector 710 from the outside of the electrical appliance protective cover 500 due to the obstructed view, so the electrical appliance protective cover 500 needs to be removed to inspect the first water level detector 710, and the operation is cumbersome. In view of this, in order to solve this problem, a side wall of the electrical appliance protective cover 500 is provided with a first notch 501, and the first notch 501 is configured to check the first water level detector 710.

Thus, the maintenance personnel can check whether the first water level detector 710 works normally through the first notch 501 of the electrical appliance protective cover 500. The maintenance personnel determine whether it is necessary to remove the electrical appliance protective cover 500 according to the structure viewed from the first notch 501, to reduce useless operations during the inspection process. For example, the maintenance personnel finds that the first water level detector 710 is not working normally, an inspection tool can extend into the electrical appliance protective cover 500 from the first notch 501 to repair the first water level detector 710; or the electrical appliance protective cover 500 is opened to repair or replace the first water level detector 710.

Figure 13:
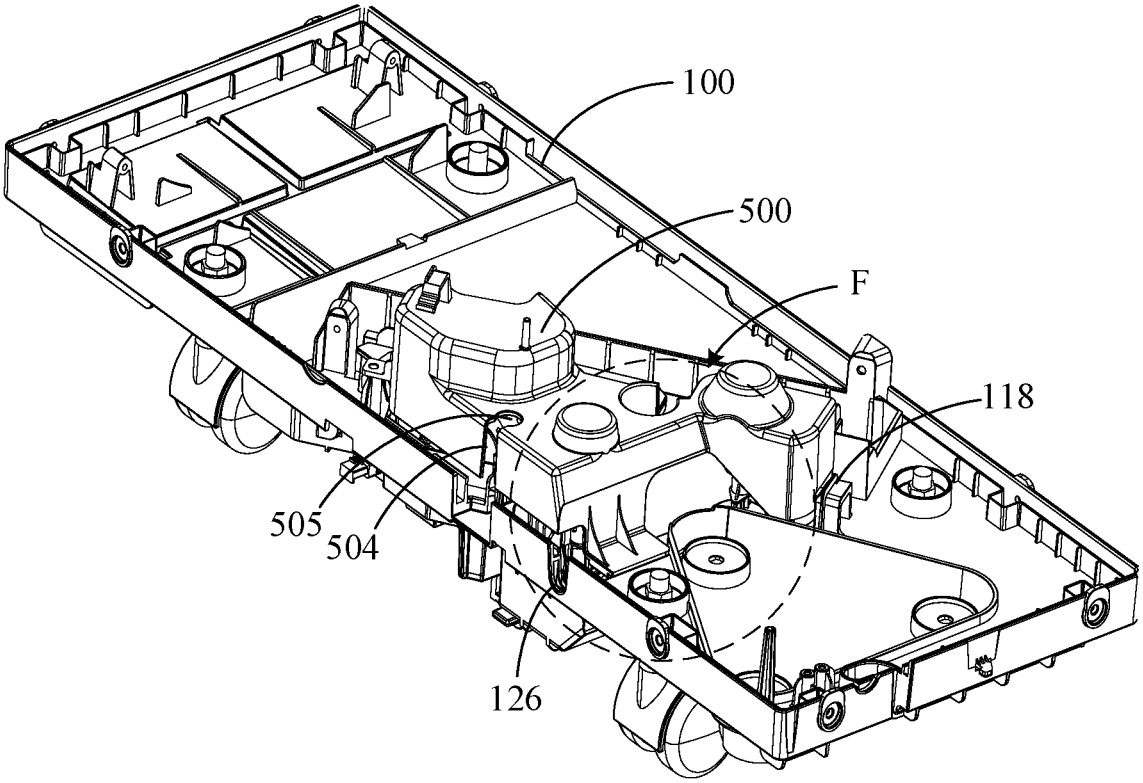
FIG. 13 is a schematic view showing the chassis engaging with the electrical appliance protective cover in FIG. 9, viewed from still another perspective.
Figure 14:
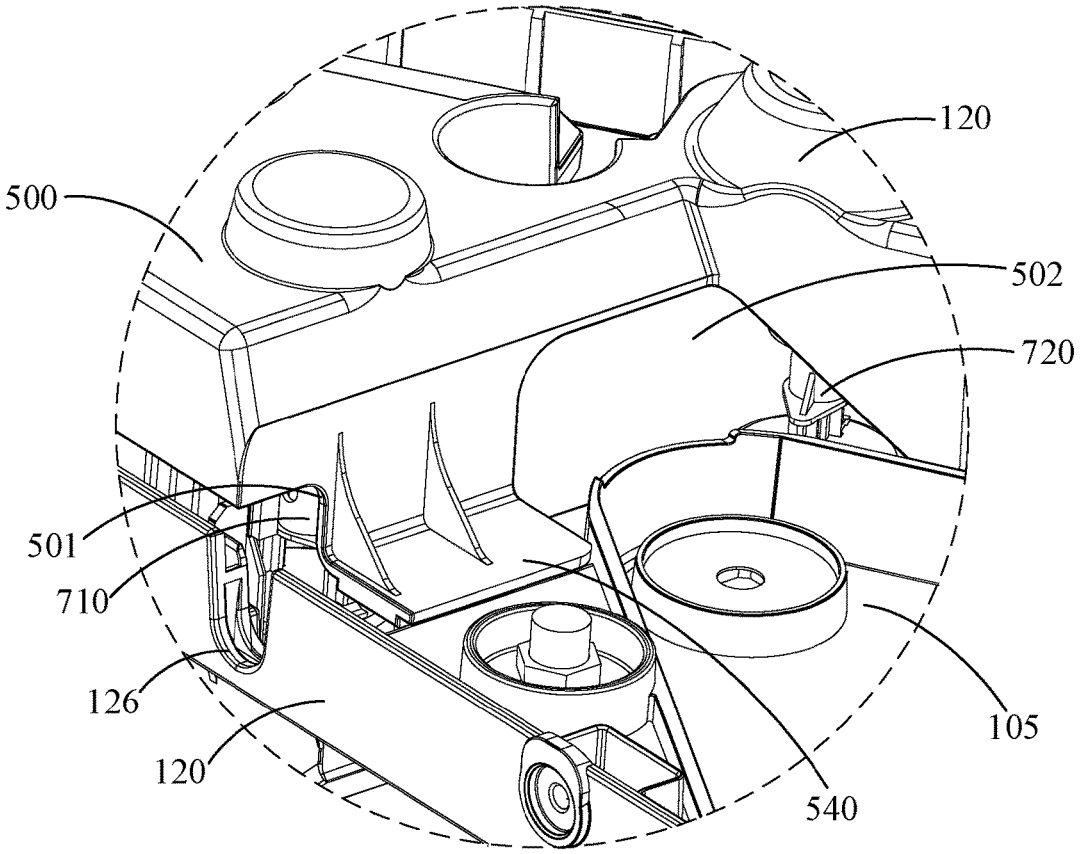
FIG. 14 is an enlarged view of portion F in FIG. 13.

As shown in FIG. 9, FIG. 13 and FIG. 14, the side plate 120 of the chassis 100 is provided with an overflow port 126, the overflow port 126 is close to the low water level detector, and the lower edge of the overflow port 126 is flush with the surface of the bottom plate 110 of the chassis 100. That is to say, the lower edge of the overflow port 126 is equivalent to the lowest overflow water level of the overflow port 126. The minimum overflow water level is flush with the upper surface of the bottom plate 110. Once the bottom plate 110 accumulates water, the water can be discharged from the overflow port 126 in time, to prevent the chassis 100 from accumulating a lot of water, thereby greatly improving the waterproof effect of the mobile air conditioner.

In an embodiment, the electrical component further includes a second water level detector 720. The second water level detector 720 is installed in the electrical appliance accommodation area 106 to detect a second water level in the electrical appliance accommodation area 106. The second water level detector 720 is spaced apart from the first water level detector 710. The second water level is higher than the first water level. When the second water level detector 720 is working, the second water level detector 720 feeds the second water level signal back to the control device of the mobile air conditioner, and then the control device receives the second water level signal for alarm or drainage.

It should be noted that the first water level detector 710 is used as a first water level defense line to protect the minimum water level required by the safety regulations of the electrical components, to prevent the electrical components from being immersed in water. The second water level detector 720 is used as a second water level defense line to protect the highest water level of the chassis to avoid overflowing water from the periphery of the chassis. The first water level detector 710 and the second water level detector 720 are switched for use in different environments. In order to facilitate the maintenance personnel to check the second water level detector 720, the side wall of the electrical appliance protective cover 500 is provided with a second notch 502, and the second notch 502 is configured to check the second water level detector 720. A support leg 540 is formed between the second notch 502 and the first notch 501 of the electrical appliance protective cover 500.

Thus, the maintenance personnel can check whether the second water level detector 720 works normally through the second notch 502 of the electrical appliance protective cover 500. The maintenance personnel determine whether it is necessary to remove the electrical appliance protective cover 500 according to the structure viewed from the second notch 502, to reduce useless operations during the inspection process. For example, the maintenance personnel finds that the second water level detector 720 is not working normally, an inspection tool can extend into the electrical appliance protective cover 500 from the second notch 502 to repair the second water level detector 720; or the electrical appliance protective cover 500 is opened to repair or replace the second water level detector 720.

As shown in FIG. 9, FIG. 13 and FIG. 16, in an embodiment, the electrical component includes a water pumping motor 620 located at a side of the water receiving groove 101, and the water pumping motor 620 is connected to the water pumping wheel 610 disposed in the water receiving groove 101 to drive the water pumping wheel 610 to work. The water pumping motor 620 and the water pumping wheel 610 constitute the water pumping assembly 600 of the mobile air conditioner. The water pumping motor 620 drives the water pumping wheel 610 to rotate, and the water pumping wheel 610 beats and transports the water in the water receiving groove 101 to the outdoor heat exchanger, to improve the heat exchange efficiency of the outdoor heat exchanger.

A third notch 503 is provided at the side wall of the electrical appliance protective cover 500 facing the water pumping wheel 610, and the third notch 503 corresponds to the water pumping motor 620 for checking the water pumping motor 620. Thus, the maintenance personnel can check whether the water pumping motor 620 works normally through the third notch 503 of the electrical appliance protective cover 500. The maintenance personnel determine whether it is necessary to remove the electrical appliance protective cover 500 according to the structure viewed from the third notch 503, to reduce useless operations during the inspection process. For example, the maintenance personnel finds that the water pumping motor 620 is not working normally, an inspection tool can extend into the electrical appliance protective cover 500 from the third notch 503 to repair the water pumping motor 620; or the electrical appliance protective cover 500 is opened to repair or replace the water pumping motor 620.

Figure 3:
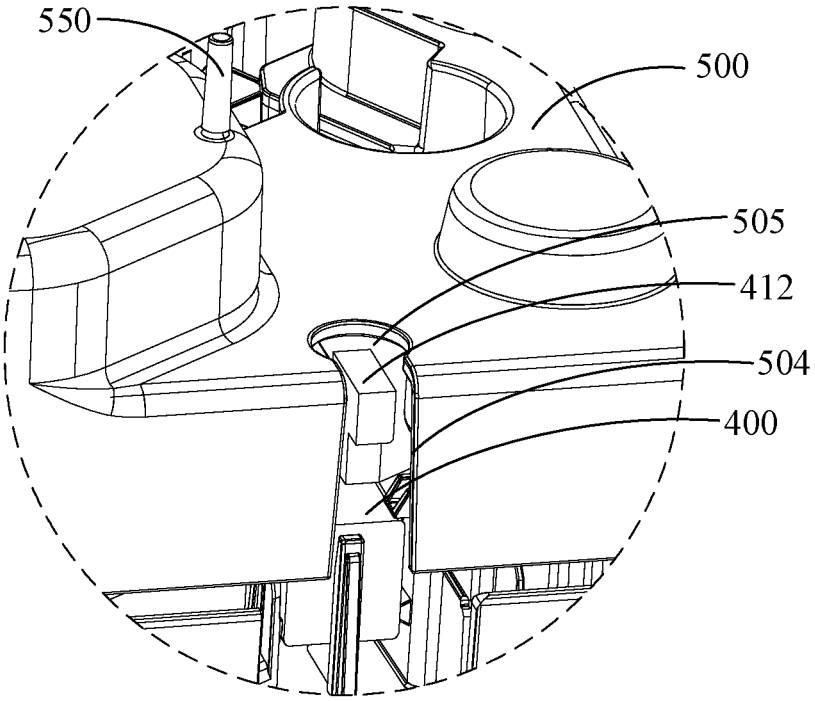
FIG. 3 is an enlarged view of portion B in FIG. 1.

As shown in FIG. 3, FIG. 9 and FIG. 15, in an embodiment, the electrical component further includes a drain valve 400. The drain valve 400 is installed in the electrical appliance accommodation area 106 to open and close a water outlet of the water receiving groove 101. After the drain valve 400 opens the water outlet, the water in the water receiving groove 101 flows out of the water outlet, then enters the drainpipe under the chassis 100, and finally drains out from the drainpipe. A fourth notch 504 is opened on a side, away from the water receiving groove 101, of the electrical appliance protective cover 500, and the fourth notch 504 corresponds to the drain valve 400, to check the drain valve 400.

Thus, the maintenance personnel can check whether the drain valve 400 works normally through the fourth notch 504 of the electrical appliance protective cover 500. The maintenance personnel determine whether it is necessary to remove the electrical appliance protective cover 500 according to the structure viewed from the fourth notch 504, to reduce useless operations during the inspection process. For example, the maintenance personnel finds that the drain valve 400 is not working normally, an inspection tool can extend into the electrical appliance protective cover 500 from the fourth notch 504 to repair the drain valve 400; or the electrical appliance protective cover 500 is opened to repair or replace the drain valve 400.

Further, a top surface of the electrical appliance protective cover 500 corresponding to the drain valve 400 is provided with a wire passage hole 505, and the wire passage hole 505 is configured for the connection wire of the drain valve 400 to pass through. The drain valve 400 is provided with a wiring terminal 412, and the wire of the wiring terminal 412 is drawn out from the wire passage hole 505. If the wire of the drain valve 400 is passed through the wire passage hole 505 inside the electrical appliance protective cover 500, it will be difficult to pass the wire due to the obstruction of the line of sight. The fourth notch 504 extends from the lower edge of the side wall of the electrical appliance protective cover 500 to the wire passage hole 505. In this way, the wire of the drain valve 400 can protrude laterally from the fourth notch 504 and then be inserted into the wire passage hole 505 along the fourth notch 504, which greatly reduces the difficulty of passing the wire.

In order to prevent the wire from falling off from the fourth notch 504, in an embodiment, a winding post 550 protrudes from a top surface of the electrical appliance protective cover, and the winding post 550 is configured to be surrounded by the wire passing through the wire passage hole 505, to position the wire on the winding post 550, so that the wire is not easy to be moved, and is difficult to escape from the fourth notch 504. When in use, the wire of the drain valve 400 extends from the fourth notch 504 to the wire passage hole 505, and is wound around the winding post 550 (wound in one or more turns), then is fixed to the clip on a side of the winding post 550, and finally connected to the electric control box.

As shown in FIG. 13, and FIG. 15 to FIG. 17, based on any one of the above embodiments, one end of the electrical appliance protective cover 500 is configured with a fixation member located at a side of the support plate 530, another end of the electrical appliance protective cover 500 is further configured with an insertion member 510, the chassis 100 is configured with an insertion part 118 and a fixation part 119, the insertion part 118 is inserted in and connected to the insertion member 510, and the fixation part 119 is fixedly connected to the fixation member 520.

The insertion part 118 of the chassis 100 is provided with a socket for inserting the insertion member of the electrical appliance protective cover 500. When installing the electrical appliance protective cover 500, the insertion member 510 of the electrical appliance protective cover 500 is firstly inserted into the socket of the insertion part 118 of the chassis 100, to pre-position the electrical appliance protective cover 500. Then, the fixation member of the electrical appliance protective cover 500 is fixedly connected to the fixation part 119 of the chassis 100 by passing through connecting members (such as screws), to fix the electrical appliance protective cover 500 to the chassis 100, the installation operation is simple and fast, and the assembly efficiency is high. It is worth mentioning that the connecting member may be a screw, and the fixation part 119 of the chassis 100 is a threaded post.

Further, a support plate 530 is configured to protrude laterally from one end of the electrical appliance protective cover 500, the support plate 530 is adjacent to the fixation member, the support plate 530 is supported on the upper end of the channel enclosure plate 910 of the bottom plate 110 to cover the opening of the channel enclosure plate 910, that is, the opening at the upper end of the wiring channel 900.

That is to say, the channel enclosure plate 910 can support the electrical appliance protective cover 500 through the support plate 530, and the support plate 530 may cover the upper edge of the channel enclosure plate 910, and also covers the opening at the upper end of the wiring channel 900. Therefore, the water inside the mobile air conditioner is not easy to fall into the floor of the room from the opening at the upper end of the wiring channel 900. In addition, due to the existence of the opening at the upper end of the wiring channel 900, it is also convenient for the chassis 100 to be ejected from the mold, thereby reducing the difficulty of ejection.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A mobile air conditioner comprising: a housing; and a wire control assembly mounted at the housing, the wire control assembly including: an adapter mounted at the housing; and a wire controller configured to receive a command signal from a control terminal and connected to the adapter.

2. The mobile air conditioner of claim 1, wherein: the housing includes a chassis, the chassis includes a bottom plate, and a lower surface of the bottom plate is provided with a mounting plate; and the adapter is mounted at the mounting plate, and a connection end of the adapter extends toward a side of the chassis to connect to the wire controller.

3. The mobile air conditioner of claim 2, wherein an upper surface of the bottom plate is provided with a wiring channel for a wire of the adapter to passthrough, an opening is formed at a lower end of the wiring channel, and the opening is located at a side of the mounting plate away from the wire controller.

4. The mobile air conditioner of claim 3, wherein:

a channel enclosure plate protrudes from the upper surface of the bottom plate and encloses to form the wiring channel; and a wire outlet hole is provided at a side wall of the channel enclosure plate and configured to lead the wire of the adapter out of the wiring channel.

5. The mobile air conditioner of claim 2, wherein:

the mounting plate is provided with an extension port for the adapter to pass through; and a positioning block is provided at a top surface of the adapter at a position away from the connection end of the adapter, and the first positioning block is configured to abut against a periphery of the extension port after the adapter protrudes from the extension port, the periphery of the extension port facing the opening.

6. The mobile air conditioner of claim 5, wherein:

the positioning block is a first positioning block and the periphery is a first periphery; and each of two opposite sides of the adapter is provided with a second positioning block, the second positioning block extending from the extension port along with the connection end of the adapter and being configured to abut against a second periphery of the extension port, and the second periphery facing away from the opening.

7. The mobile air conditioner of claim 6, wherein the second positioning block is provided with a front guide surface in a slope shape, and the front guide surface extends from a top of the second positioning block toward the connection end of the adapter.

8. The mobile air conditioner of claim 6, wherein the second positioning block is provided with a rear guide surface in a slope shape, and the rear guide surface extends from a top of the second positioning block to be away from the connection end of the adapter.

9. The mobile air conditioner of claim 5, wherein: the positioning block is a first positioning block; a second positioning block is provided at the top surface of the adapter at a position close to the connection end of the adapter; and an elastic buckle is provided at the wire controller, and the elastic buckle is configured to buckle and fix with the second positioning block after the wire controller is inserted in and connected to the connection end.

10. The mobile air conditioner of claim 1, wherein the housing includes a chassis provided with a water receiving groove and an installation position for installing a compressor, and an electrical appliance accommodation area between the water receiving groove and the installation position is configured to accommodate an electrical component.

11. The mobile air conditioner of claim 10, further comprising:

an electrical appliance protective cover provided in the electrical appliance accommodation area;

wherein:

an upper surface of a bottom plate of the chassis is provided with a wiring channel; and the electrical appliance protective cover is configured to cover at least one of the electrical component or the wiring channel in the electrical appliance accommodation area.

12. The mobile air conditioner of claim 11, wherein:

the electrical component includes a water level detector installed in the electrical appliance accommodation area to detect a water level in the electrical appliance accommodation area; and a side wall of the electrical appliance protective cover is provided with a notch configured to allow the water level detector be checked.

13. The mobile air conditioner of claim 12, wherein:

the water level detector is a first water level detector, the water level is a first water level, and the notch is a first notch; and the electrical component further includes a second water level detector installed in the electrical appliance accommodation area to detect a second water level in the electrical appliance accommodation area, the second water level being higher than the first water level; and the side wall of the electrical appliance protective cover is provided with a second notch configured to allow the second water level detector be checked.

14. The mobile air conditioner of claim 11, wherein:

the electrical component includes a water pumping motor installed in the electrical appliance accommodation area and connected to a water pumping wheel provided in the water receiving groove; and a notch is provided at a side wall of the electrical appliance protective cover, the side wall faces the water pumping wheel, and the notch corresponding to the water pumping motor and being configured to allow the water pumping motor to be checked.

15. The mobile air conditioner of claim 11, wherein:

the electrical component includes a drain valve installed in the electrical appliance accommodation area to open or close a water outlet of the water receiving groove; and a notch is opened on a side of the electrical appliance protective cover, the side of the electrical appliance protective cover facing away from the water receiving groove, and the notch corresponding to the drain valve and being configured to allow the drain valve to be checked.

16. The mobile air conditioner of claim 15, wherein a top surface of the electrical appliance protective cover corresponding to the drain valve is provided with a wire passage hole, the wire passage hole is configured for a wire of the drain valve to pass through, and the notch extends from a lower edge of the side wall of the electrical appliance protective cover to the wire passage hole.

17. The mobile air conditioner of claim 16, wherein a winding post is provided at the top surface of the electrical appliance protective cover, and the winding post is located at a side of the wire passage hole and is configured to allow the wire drawn from the wire passage hole to wind on the winding post.

18. The mobile air conditioner of claim 11, wherein:

one end of the electrical appliance protective cover is configured with a fixation member, and another end of the electrical appliance protective cover is configured with an insertion member; and the chassis is configured with an insertion part and a fixation part, the insertion part is inserted in and connected to the insertion member, and the fixation part is fixedly connected to the fixation member.

19. The mobile air conditioner of claim 18, wherein a support plate is configured to protrude laterally from one end of the electrical appliance protective cover, the support plate is adjacent to the fixation member, is supported on an upper end of the channel enclosure plate of the bottom plate, and is configured to cover the opening of the channel enclosure plate.

* * * * *